United States Patent [19]

Gilroy

[11] Patent Number: 4,940,171

[45] Date of Patent: Jul. 10, 1990

[54] AEROSOL PACKAGE HAVING COMPRESSED GAS PROPELLANT AND VAPOR TAP OF MINUTE SIZE

[76] Inventor: Gordon C. Gilroy, R.F.D. 2, Darby La., Bedford, N.H. 03102

[21] Appl. No.: 354,125

[22] Filed: May 18, 1989

[51] Int. Cl.[5] ..... B65D 83/58

[52] U.S. Cl. ..... 222/402.18; 222/402.1

[58] Field of Search ..... 222/402.1, 402.18, 402.24, 222/464; 239/337, 340, 372

[56] References Cited

U.S. PATENT DOCUMENTS

| | | | |
|---|---|---|---|
| 3,260,421 | 7/1966 | Rabussier | 222/402.18 |
| 3,575,323 | 4/1971 | Steinman | 222/402.21 |
| 3,647,119 | 3/1972 | Samuelson | 222/402.18 |
| 4,061,252 | 12/1977 | Riccio | 222/402.24 X |
| 4,247,024 | 1/1981 | Vogel | 222/402.16 |
| 4,398,654 | 8/1983 | Pong et al. | 222/402.1 |
| 4,431,120 | 2/1984 | Burger | 222/192 |

FOREIGN PATENT DOCUMENTS

| | | | |
|---|---|---|---|
| 1048453 | 7/1976 | Canada | 222/402.18 |

*Primary Examiner*—Michael S. Huppert
*Attorney, Agent, or Firm*—Dallett Hoopes

[57] ABSTRACT

Aerosol package employs a compressed gas such as carbon dioxide or nitrous oxide as propellant and provides a tiny vapor tap in the aerosol valve body to permit, in a restricted controlled way, the passage of the propellant gas into the aerosol valve. The diameter of the vapor tap is preferably in the range of only about 0.004" to only about 0.008". In a modification a pair of vapor tap openings of 0.006" diameter are formed in the valve. This permits a lesser initial can pressure.

7 Claims, 1 Drawing Sheet

AEROSOL PACKAGE HAVING COMPRESSED GAS PROPELLANT AND VAPOR TAP OF MINUTE SIZE

BACKGROUND OF THE INVENTION

1. Field of the Invention

This invention relates to an aerosol package of the well knwon type in which a valve is mounted at its upper end and has an actuator button. More specifically, this invention relates to such a package in which the propellant is a compressed gas which pressurizes the aerosol container during filling.

2. Description of Related Art including Information Disclosed under §§1.97 to 1.99

In the past by far the dominant portion of aerosol packages have had as their propellant a liquid which has been mixed in with the aerosol product and which has had a comparatively low vapor pressure of about 30 psi. As the product has been propelled out with the aerosol discharge, the pressure has dropped and correspondingly more of the liquid propellant has gone into the vapor phase, renewing the presssure above the liquid and providing a propellant gas until the product has been used up.

The liquid propellant selected for use in most cases up until five years ago has been a chlorofluorocarbon (CFC). However, with environmental problems (including the deterioration of the ozone layer) government regulations have required that the use of such propellants be discontinued. Other propellants, such as butane, have been used but, of course, they are flammable and inappropriate in many applications.

Where the liquid product has been a food, such as whipped cream or cheese spread, the propellant has been in the form of compressed gas such as nitrogen or carbon dioxide. This has been satisfactory provided that the gas imposed on the containers has been under sufficient pressure to evacuate the entire package. Often to keep the gas and food products separate, the food has been disposed in a flexible bag within the aerosol container and the gas pressure has been imposed on the outside of the bag.

More recently, because of the environmental concern, the use of carbon dioxide, for instance, has been experimented with for insecticides and paints but it has been found that the spray patterns and other characteristics resulting from such aerosols have changed widely during the life of the package so that what at first has given a satisfactory spray pattern has produced an unacceptable spray pattern at the end of the package of vice versa.

Preferably, nitrous oxide or carbon dioxide has been used because they are somewhat soluble in most liquid products and, hence, have benefited the spray characteristics somewhat as they have come out of solution during discharge. Improved spray characteristics have been sought.

With liquid propellants such as CFC's it has been common to employ a vapor tap. A vapor tap, as is well known, is a passage which connects the gas above the liquid product in the container with the inside of the aerosol valve. Vapor taps have been used with such propellants to add to the liquid in the valve some of the vapor phase which acts to give a finer break-up, a lower delivery rate and a warmer spray. Vapor tap holes down to 0.005" have been made by laser equipment.

Insofar as I am aware, there have been no attempts to employ any kind of a vapor tap when working with compressed gas propellants. Such an arrangement has not been tried because one would expect that the gas, under relatively high pressure, would move directly and quickly through the vapor tap through the valve chamber and out the aerosol discharge, leaving the container with no propellant. Unlike with a liquid propellant, the compressed gas does not self-regulate between discharges, adding vapor phase when the pressure drops. Instead, when the pressure of the compressed gas drops, it does not "recover".

SUMMARY OF THE INVENTION

I have found that, contrary to what one would expect, an aerosol package using a slightly soluble gas propellant such as carbon dioxide, can benefit by the incorporation of a vapor tap into the valve chamber provided the opening in the vapor tap is smaller, for instance only 0.004" to only 0.008",—perhaps one half the diameter of the vapor tap which has been normally used with liquid propellants. The benefits are in the form of more uniform spray patterns with only slight dispersion of particles toward the end of the package. Test units produce a finer, dryer spray than units without the vapor tap.

Preferably the vapor tap in embodiments of the invention are located in the bottom wall of the aerosol valve housing.

BRIEF DESCRIPTION OF THE DRAWINGS

Other features and objects of the invention will be clear from a study of the following specification and claims, all of which disclosed a non-limiting embodiment. In the drawings:

DESCRIPTION OF THE PREFERRED EMBODIMENT

Figure 1:
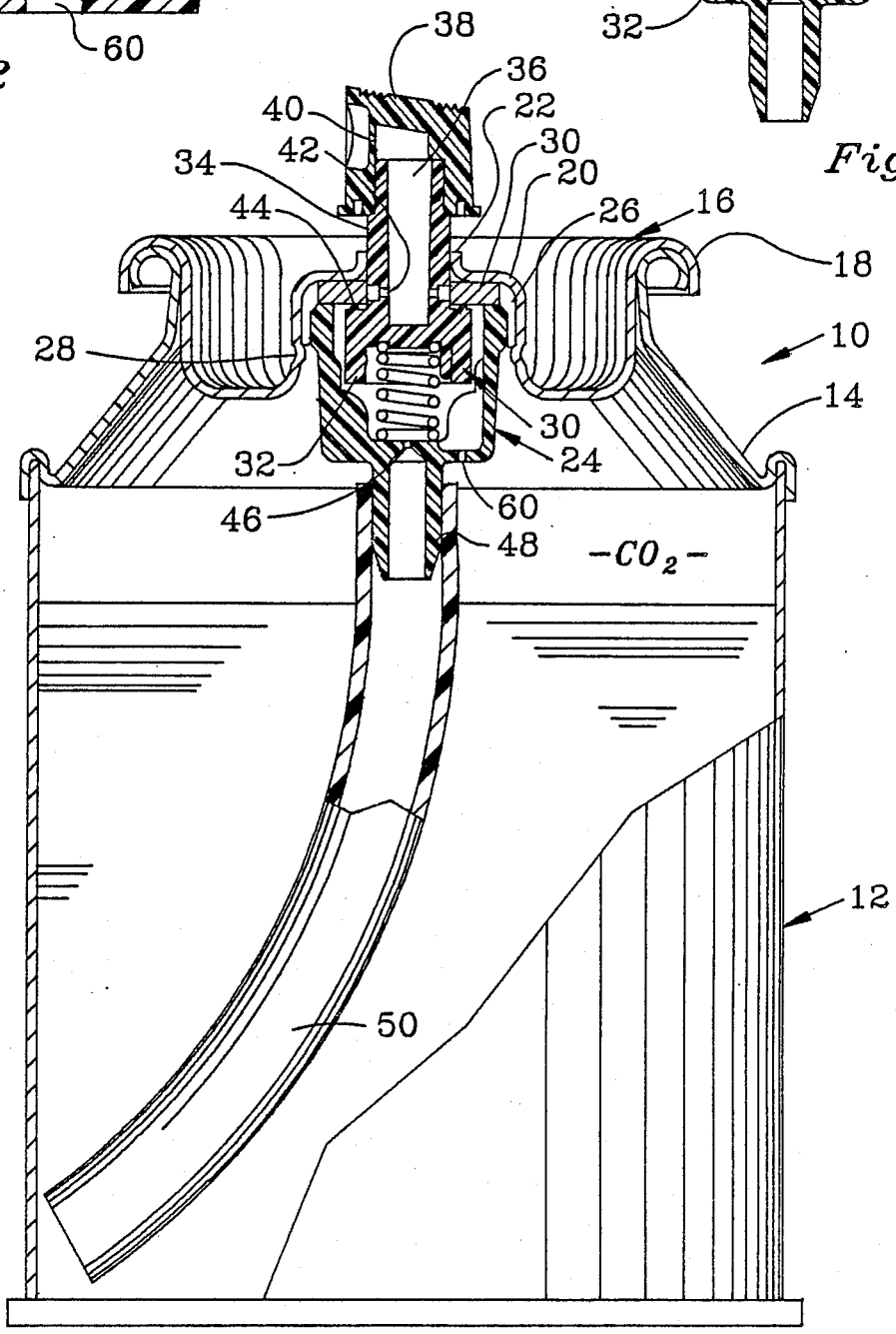
FIG. 1 is a vertical sectional view of an aerosol package embodying the invention.

An aerosol package embodying the invention is shown in FIG. 1 and generally designated 10. It comprises a conventional metal container 12 having a sloping upper wall 14. The upper end of the wall 14 is closed off by an aerosol mounting cup, the periphery of which is curled onto wall 14 as at 18. The mounting cup has an annular depression and a central upward pedestal 20 having in its upper end a central opening 22.

A plastic cup-shaped valve housing or body 24 is formed at its upper end with spaced outward projections 26 under which the pedestal 20 is inwardly crimped as at 28 to fixedly mount the cup to support the valve body.

Sidewalls of the body 24 fall short of the upper end of the projections 26 and present an annular support for a gasket 30 which is sealingly disposed between the upper end of the sidewalls and the top of the pedestal.

A valve plunger 30 is disposed with its head 32 inside the body 24. The upper end of the plunger is in the form of a tubular stem 34 which extends up through the gasket 30 and through the opening 22 in the mounting cup.

The stem features a central passage 36, and an actuator button 38 is pressed on to the top of the stem and provides a discharge orifice 40 communicating with the passage 36 in the stem. Radial channels 42 are formed in the tubular stem 34 in alignment with the gasket 31 when the valve is closed to shut off flow. The upper end of the head 32 is provided with an annular seat 44 which engages the gasket 31 to provide further sealing.

The bottom wall of the valve body 24 is formed with an orifice 46 into an integral tailpiece 48, and a dip tube 40 of relatively flexible plastic such as polyethylene is snugly telescoped over the tailpiece.

During filling of the unit the liquid product P may be fed into the container 12 before the mounting cup 16 is installed to close off the opening in the upper wall 14 of the container. Subsequently and prior to the final closing of the package, the propellant gas such as $CO_2$, which may be slightly soluble in the product P, is forced into the container by means of a filling head forcing the gas over the gasket 31 and into the space above the liquid P.

An essential element of the invention is the provision of the vapor tap 60. Vapor taps are well known in the prior art and shown, for example, in the valve disclosed in the U.S. Pat. No. 3,575,320 which issued Apr. 20, 1971 to Jimmie Mason.

Figure 2:
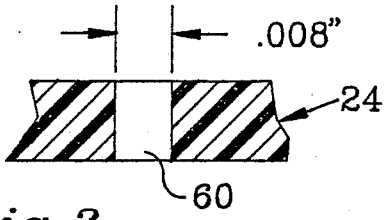
FIG. 2 is an enlarged fragmentary sectional view of a vapor tap in an embodiment of the invention.

In the present embodiment 1 as shown in the enlargement of FIG. 2, the vapor tap 60 is preferably about 0.008" in diameter although it can be smaller if desired, a range of only about 0.004" to only about 0.008" being preferred. Preferably the vapor tap in embodiments of the invention is located in the bottom well rather than in the side wall of the valve body 24.

Surprisingly, rather than the gas such as $CO_2$ under relatively high pressure bleeding immediately off through the vapor tap and out the valve, apparently the small opening 60 meters the flow sufficiently so that it permits gas to enter into the liquid flow into the valve body, expanding as the pressure lessens through the outlet and assisting in the uniform expansion and vaporization of the product.

The following test results will be a further assist in understanding the invention.

EXPERIMENTAL PROCEDURE & TEST CONDITIONS:

All laboratory aerosol package units were identical (except for the presence or absence of a vapor tap) and were filled with the following fill ratio:

35% headspace in a 202×509 tinplate can
147.68 grams of SDA-40 alcohol
pressurized to 120 psig w/$CO_2$
vacuum crimped @ 18" Hg.

The valve had a restricted entry (item 46 in FIG. 1) of 0.013" diameter.

Some units had a 0.008" vapor tap as shown in the drawing—others had no vapor tap at all.

All units were allowed to equilibrate in a constant temperature bath (70° F. +/−1° F.) for at least one hour before testing. Spray rates were obtained in grams per 10 seconds utilizing the following technique; units were tared, sprayed for 10 seconds, and reweighed. Spray patterns were obtained from a distance of 8" from alcohol sensitive paper. Measurements were conducted at full, ½, ¼ and near empty intervals.

RESULTS WITH NO VAPOR TAP

| CONDITION | VAPOR PRESSURE (psig) | SPRAY % RATE % (g/10 sec) | SPRAY PATTERN & PART SIZE (@ 8") |
|---|---|---|---|
| FULL | 120 | 13.94 | 3½" round, solid, coarse particles, very wet |
| ½ FULL | 109 | 13.12 | 3¼–3½" round, solid, coarse particles, very wet |
| ¼ FULL | 96 | 12.72 | 3⅛–3¼" round, solid, coarse particles, very wet |
| NEAR EMPTY | 93 | 11.52 | 4–4¼" round, solid, coarse particles, very wet |

Cans were completely evacuated with an average of 80 psig remaining in the cans

RESULTS WITH .008" VAPOR TAP

| CONDITION | VAPOR PRESSURE (psig) | SPRAY % RATE % (g/10 sec) | SPRAY PATTERN & PART. SIZE (@ 8") |
|---|---|---|---|
| FULL | 120 | 10.81 | 3" round, solid, fine break-up, misty, dry |
| ½ FULL | 99 | 9.83 | 3" round, solid, fine break-up, misty, dry |
| ¼ FULL | 84 | 9.30 | 3" round, solid, fine break-up, misty, dry |
| NEAR EMPTY | 68 | 8.66 | 3" round, " solid, fine break-up, misty, dry |

Cans were completely evacuated with an average of 46 psig remaining in the cans

From the above it can be seen that by bleeding some of the carbon dioxide through tap 60 into the product, a uniform spray pattern is experienced throughout the life of the package. The unit with the 0.008" vapor tap will also produce a finer, drier spray. With an 0.008" vapor tap, the spray rate is lower but the unit completely evacuates it product with commendable spray performance.

Figure 3:
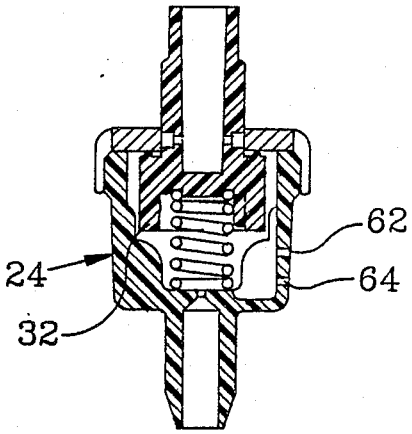
FIG. 3 is a vertical sectional view showing a modification.

In a modification (FIG. 3), using as otherwise described above, a vapor tap in the form of a plurality of tiny holes 62, 64 in the valve body makes it possible to use less initial gas pressure in the package. Specifically, a pair of holes 0.006" in diameter in the side wall of the valve body worked satisfactorily with an initial pressure of only 92 psi. When the product was used up the pressure was 50 psi. Because of the greater gas flow through the vapor taps the restricted entry into the valve (item 46 in FIG. 1) of 0.062" diameter was selected:

RESULTS WITH TWO .006" VAPOR TAPS

| CONDITION | VAPOR PRESSURE (psig) | SPRAY % RATE % (g/10 sec) | SPRAY PATTERN & PART. SIZE (@ 8") |
|---|---|---|---|
| FULL | 92 | 10.41 | 4–4½ round solid, medium to fine |
| ½ FULL | 78 | 9.33 | 4–4½ round solid, medium to fine |
| ¼ FULL | 66 | 8.36 | 4–4½ round solid, medium to fine |
| NEAR EMPTY | 58 | 5.20 | 4–4½ round solid, medium to fine |
| AVERAGE | 74 | 8.33 | 4–4½ round solid, medium to fine |

50 psig left in unit when empty.

It can be seen that here again the spray pattern of the valve is consistent and there is ample pressure to drive all product out of the valve.

It should be understood that the invention is not limited to the specific arrangements disclosed. Instead the invention may be thought of as defined by following claim language or equivalents thereof.

What is claimed is:

1. In an aerosol package comprising a container and a dispenser valve mounted on the container, the valve comprising a cylindrical body mounted upright at the center of the top of the container and having a bottom wall and a gasket at its upper end and a plunger in the body having a hollow stem passing up through the gasket and through the top of container and terminating in an actuator operable from the top of the container, a dip tube connected to and extending from the cylindrical body down in the container, the container being partly filled with liquid product and having thereabove an atmosphere of compressed gas selected from a group including carbon dioxide and nitrous oxide to propel the liquid up the dip tube and through the valve and out the actuator when the valve is open; the improvement of at least one vapor tap opening in the cylindrical body above the level of the liquid product whereby said compressed gas is free to flow through the vapor tap opening and through the dispenser valve when the valve is open, each vapor tap opening having a diameter in the range of only about 0.004 inch to only about 0.008 inch.

2. An aerosol package as claimed in claim 1 wherein there is only one opening and the diameter of the opening is 0.008".

3. An aerosol package as claimed in claim 1 wherein the cylindrical body has a bottom wall and the vapor tap opening is in the bottom wall.

4. An aerosol package as claimed in claim 1 wherein the pressure of the gas is in the range of about 80 psi to 120 psi.

5. An aerosol package as claimed in claim 1 wherein the gas is carbon dioxide under pressure of about 80 psi to 120 psi.

6. An aerosol package as claimed in claim 1 wherein there are two vapor tap openings and they are each 0.006" in diameter.

7. An aerosol package as claimed in claim 6 wherein the openings are both in the sidewall of the body of the dispensing valve.

* * * * *